US007757523B1

(12) United States Patent
Garcia et al.

(10) Patent No.: US 7,757,523 B1
(45) Date of Patent: Jul. 20, 2010

(54) GATE MULTI-LOCKING APPARATUS

(75) Inventors: Angel Garcia, 4015 Shadybrook Ct., Granite Bay, CA (US) 95746; Charles Y. D. Lee, Elk Grove, CA (US)

(73) Assignee: Angel Garcia, Granite Bay, CA (US)

( * ) Notice: Subject to any disclaimer, the term of this patent is extended or adjusted under 35 U.S.C. 154(b) by 4 days.

(21) Appl. No.: 12/228,701

(22) Filed: Aug. 14, 2008

(51) Int. Cl.
*E05B 65/06* (2006.01)

(52) U.S. Cl. ..... 70/129; 70/14; 70/20; 70/56; 70/DIG. 63; 70/DIG. 65; 292/148

(58) Field of Classification Search ..... 70/2, 70/11, 14, 129, 134, 54–56, DIG. 63, DIG. 65; 292/148, 153
See application file for complete search history.

(56) References Cited

U.S. PATENT DOCUMENTS

| | | | | | |
|---|---|---|---|---|---|
| 2,707,125 | A * | 4/1955 | Ritter, Sr. | ..... | 292/148 |
| 3,889,497 | A * | 6/1975 | Tuttle | ..... | 70/14 |
| 3,906,760 | A * | 9/1975 | Parker, Jr. | ..... | 70/154 |
| 4,997,219 | A * | 3/1991 | Carter | ..... | 292/148 |
| 5,020,342 | A * | 6/1991 | Doan et al. | ..... | 70/14 |
| 5,868,015 | A * | 2/1999 | Eaker | ..... | 70/129 |
| 6,755,053 | B1 * | 6/2004 | Dias | ..... | 70/14 |
| 6,857,299 | B2 * | 2/2005 | McNeil | ..... | 292/148 |
| 7,000,440 | B2 * | 2/2006 | Martin | ..... | 292/148 |
| 7,503,194 | B2 * | 3/2009 | McNeil | ..... | 70/14 |
| 2008/0041123 | A1 * | 2/2008 | McKee | ..... | 70/129 |

OTHER PUBLICATIONS

Tubular Frame Adaptor made available by Tayhope Enterprises, Ltd. of Toronto, Canada—Tayhope Catalog.
An arrangement disclosed in the website: www.kk.org/streetuse/archives/2008/04one_gate_multiple_locks.php.

* cited by examiner

*Primary Examiner*—Peter M Cuomo
*Assistant Examiner*—Christopher Boswell
(74) *Attorney, Agent, or Firm*—Thomas R. Lampe

(57) ABSTRACT

Gate multi-locking apparatus includes two housings, one attached to a gate member and the other attached to a structural member. A latch bar is positioned externally of the housings and extends between the housings to prevent movement of the gate member to open position. Latch bar supports extend into the housings and are locked in place by lock members extending therethrough and padlocks holding the lock members in place.

10 Claims, 3 Drawing Sheets

GATE MULTI-LOCKING APPARATUS

TECHNICAL FIELD

This invention relates to a gate locking system and more particularly to apparatus enabling a number of people to lock or unlock a gate even though such persons have their own separate and different padlocks and padlock keys.

BACKGROUND OF THE INVENTION

Numerous situations exist wherein a common gate is employed by a plurality of persons. For example, alleyways and other common areas are often closed by gates which must be opened by different parties, including occupants of residences and commercial buildings served by the common areas and persons working for fire departments or other government agencies and public utility companies.

Several arrangements are known in the prior art which allow opening or closing of a gate by persons employing different and separate locks. For example, a tubular frame adaptor made available by Tayhope Enterprises Ltd. of Toronto, Canada allows multi-locks to be employed by utilizing a rectangular lock frame receiving a plurality of inserts disposed side-by-side and which (when all inserts are in position) cooperates with a lock element at the end of a chain to perform the locking function. Different padlocks are attached to these inserts, enabling individuals to remove their own padlock and associated insert so that the chain is unlocked and a gate opened.

It is also known to utilize multiple locks connected together to form one long chain of locks. Opening any one lock will open the lock chain and allow opening of the gate. An example of such an arrangement is disclosed on the following website:

www.kk.org/streetuse/archives/2008/04one_gate_multiple-_locks.php. The same website also discloses a gate latch employing a slidable elongated latch member which can only be opened if spacers disposed end-to-end along the length of the latch member are not all in place. Each spacer is associated with a different padlock. Removal of one padlock and its associated spacer will enable the latch to be pulled open.

The prior art arrangements disclosed above have a number of drawbacks. The padlocks, including shackles, are completely exposed and can readily be cut or sawn to remove the locks as obstacles to opening the gate with which they are associated. In addition, the locks are exposed to the elements, prolonged exposure to which can damage the locks and associated structure and even render the locks inoperative. Additionally, many arrangements, particularly those involving a chain of locks, are unsightly.

DISCLOSURE OF INVENTION

The present invention relates to a gate multi-locking apparatus of a unique character which provides a highly effective and unique approach to locking a gate and opening the gate in which separate different padlocks are employed. The padlocks are maintained in a protected condition and placed so that cutting of the shackles or destruction or breakage of the locks in some other manner is extremely difficult. Furthermore, the apparatus of the present invention is characterized by its strength, reliability, and ease of use, while also presenting a pleasing appearance.

The gate multi-locking apparatus of the present invention includes a gate member having a gate end and movable between an open position and a closed position.

A first housing is attached to the gate member and defines a first housing interior. A second housing is attached to a structural member, such as another gate member, adjacent to the gate end.

A double-ended latch bar is positioned externally of the first and second housings and extends therebetween to prevent movement of the gate member from its closed position to its open position.

A first latch bar support supports the latch bar externally of the first housing, extends into the first housing and has a distal end portion positioned within the interior of the first housing.

A second latch bar support is spaced from the first latch bar support supporting the latch bar externally of the second housing, extending into the second housing and having a distal end portion positioned in the interior of the second housing. The distal end portions of the first and second latch bar supports define latch bar support openings.

A first lock member extends through the latch bar support opening of the first latch bar support and locks the first latch bar support to the first housing to prevent the first latch bar support and the latch bar from being separated from the first housing.

A second lock member extends through the latch bar support opening of the second latch bar support and locks the second latch bar support to the second housing to prevent the second latch bar support and the latch bar from being separated from the second housing.

At least one padlock is disposed in the interior of the first housing and releasably connected to the first lock member to selectively retain the first lock member in the latch bar support opening defined by the first latch bar support. At least one padlock is in the interior of the second housing releasably connected to the second lock member to selectively retain the second lock member in the latch bar support opening defined by the second latch bar support.

Removal of a padlock from either of the first and second lock members enables removal of a lock member from a latch bar support opening and separation of a latch bar support and latch bar from a housing whereby the latch bar will not prevent movement of the gate member to its open position.

Other features, advantages and objects of the present invention will become apparent with reference to the following description and accompanying drawings.

MODES FOR CARRYING OUT THE INVENTION

Figure 1:
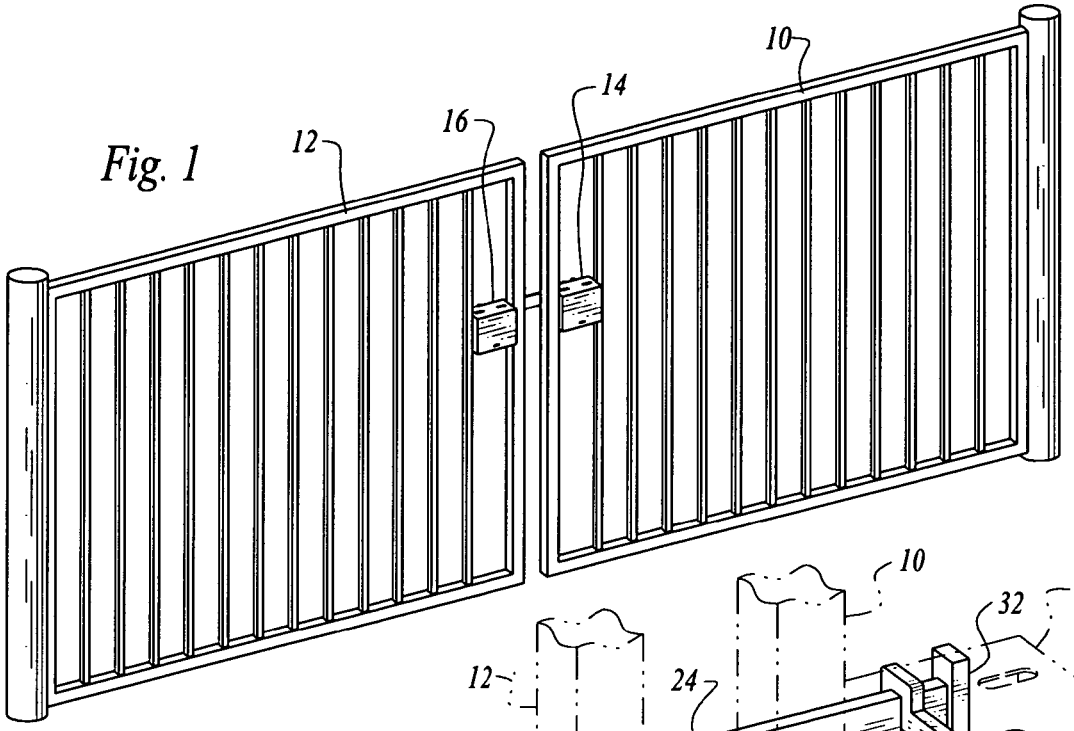
FIG. 1 is a perspective view illustrating the back of a gate formed by two relatively movable gate members with housings attached at ends thereof and a latch bar extending between the housings and between the gate members to lock the gate members against opening.
Figure 2:
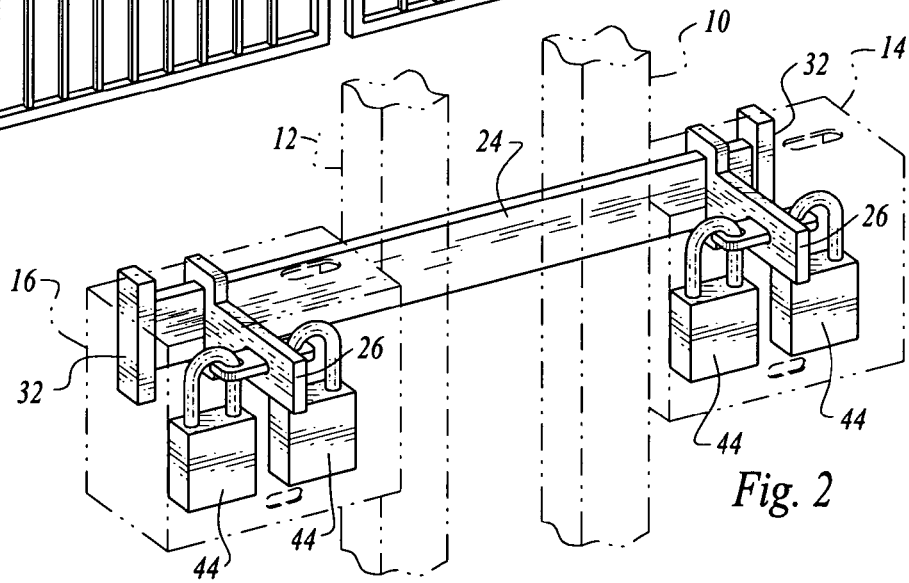
FIG. 2 is an enlarged, perspective rear view (as seen from the back of the gate) illustrating portions of the gate members and housings in phantom line and selected structural components of the apparatus, including the latch bar, latch bar supports, lock members and padlocks in solid line, the gate members being locked in closed condition.
Figure 3:
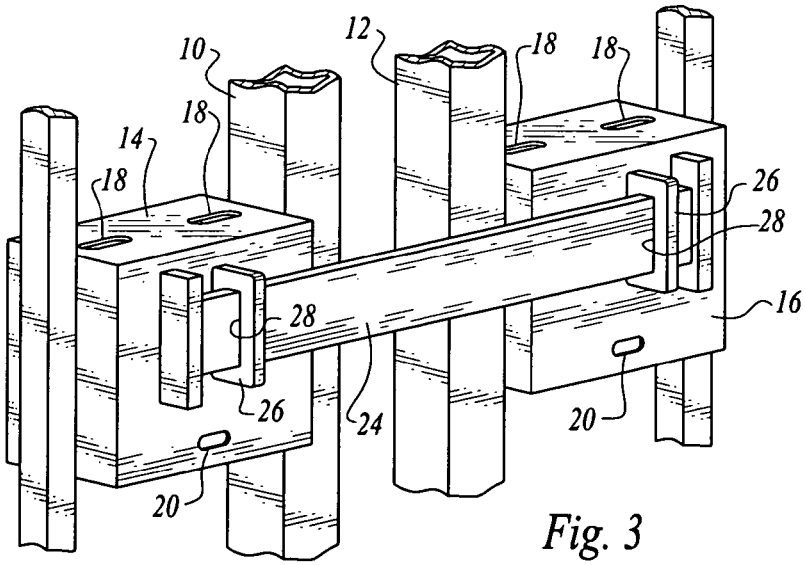
FIG. 3 is an enlarged, front perspective view illustrating portions of the gate members, the housings affixed thereto and the latch bar extending between the housings to maintain the gate members in locked condition.
Figure 6:
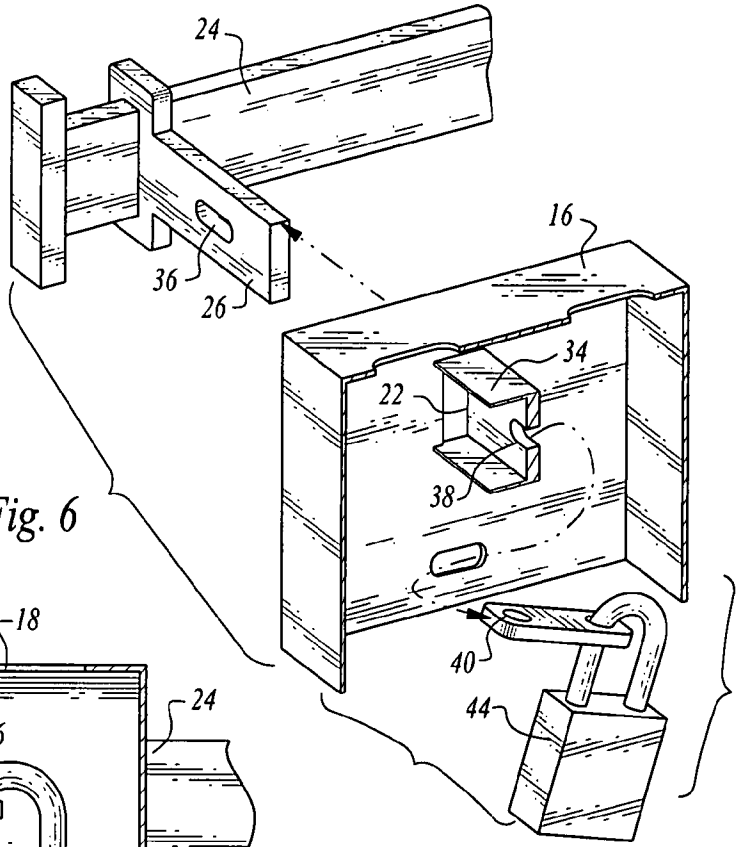
FIG. 6 is an exploded view illustrating the lock member and padlock attached thereto having been removed from the housing and from the latch bar support, the latch bar support and the latch bar separated from the housing so that the gate member can be opened.

Referring now to FIGS. 1-11, two conventional pivotally mounted, swinging gate members 10, 12, as viewed from the back, are illustrated. Attached to gate members 10, 12 are housings 14, 16, respectively, the housings being of identical construction and suitably formed of steel or other metal. The housings are welded or otherwise securely attached in place.

Each housing has four sides and a top, the bottom of the housings being essentially open to the interior of the housings. Each of the housings defines view holes 18 and 20 for viewing the interiors of the housings. Openings 20 also serve a different purpose as will be indicated below. The housings also define housing openings 22.

A double-ended latch bar 24 is positioned externally of the housings and extends therebetween to prevent movement of the gate members from their closed positions to their open positions.

Two latch bar supports 26 of identical construction are slidably connected to the latch bar, the latch bar passing through apertures 28 formed by the latch bar supports. The latch bar supports 26 may be moved as illustrated by the double-headed arrows in FIG. 11 along the length of the latch bar to allow the latch bar supports to align with housing openings 22. The latch bar has stops 32 at the ends thereof for maintaining the latch bar supports and the latch bar interconnected.

When the gate members 10, 12 are latched together in closed condition as shown in FIG. 1, for example, the latch bar supports extend into the housings through housing openings 22, as shown in FIGS. 2-5 and 7, for example, with distal end portions 30 of the latch bar supports positioned within the interiors of the housings. Stabilizer structure 34 is located within the interiors of the housings adjacent to the housing openings for stabilizing the distal end portions. The stabilizer structure 34 is in the shape of a three sided channel extending from the front of the housing to the back thereof. A slot 38 is formed in each of the channels. See FIG. 6.

The distal end portions 30 of the latch bar supports define latch bar support openings 36 in the form of slots. Lock members 40 are positioned through the latch bar support openings 36 so that opposed ends of the lock members 40 are located on opposed sides of the respective latch bar supports. The lock members also pass through slots 38 of the channels 34. The lock members, when so positioned, will lock the latch bar supports to the housings to prevent the latch bar supports and the latch bar 24 from being separated from the housings.

Lock members 40 define two lock members openings 42 spaced from one another and disposed on opposite sides of the associated latch bar support. The lock member openings 42 receive the shackles of padlocks 44. As shown in FIGS. 2, 4, 7 and 10, two padlocks 44 are located in each of the housings. These padlocks are protected from the elements as well as being positioned so that it is extremely difficult to saw, cut or otherwise break the padlocks. When the two padlocks 44 are connected to the lock members 40, the lock members are locked in place and in cooperation with channel 34 lock the latch bar supports against outward movement. The view holes in the housings assist an individual when positioning the padlocks in place and securing them in position. This of course is accomplished manually through the open bottom of the housings. Manual access to the padlocks may be had from either the front or the back of the gate.

Figure 8:
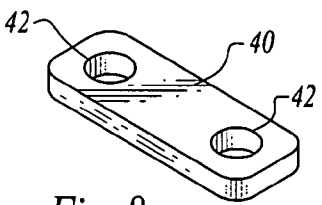
FIG. 8 is a top, perspective view of a lock member.
Figure 7:
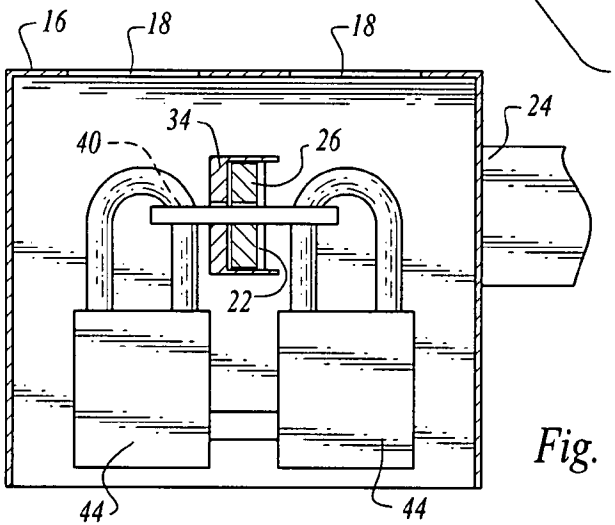
FIG. 7 is an enlarged, cross-sectional view taken along line 7-7 of FIG. 10.
Figure 4:
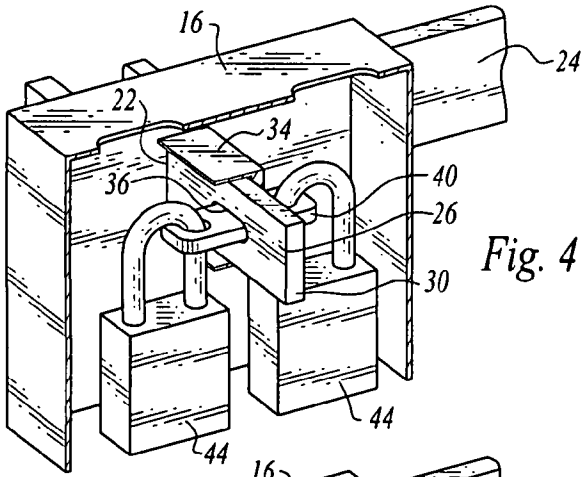
FIG. 4 is an enlarged, perspective view illustrating a portion of a housing broken away to expose the interior thereof accommodating an end portion of a latch bar support, a lock member passing through an opening therein and two padlocks attached to opposite ends of the lock member.
Figure 5:
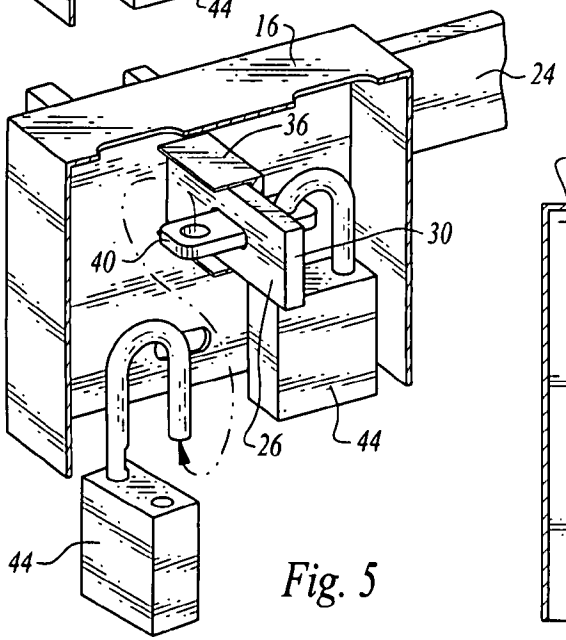
FIG. 5 is a view similar to FIG. 4, but illustrating one of the padlocks having been removed.

When one wishes to unlatch the gate member, this may be accomplished by unlocking and removing any one of the four padlocks. FIG. 5 shows one of the padlocks 44 having been removed. This allows the lock member 40 with which it had been associated to be slid out of the latch bar support and away from a notch in the stabilizer structure 34, as shown in FIG. 8. This allows the latch bar support illustrated in that figure to be separated from the housing along with latch bar 24. Again, it is worthy of note that this can be accomplished when any one of the four padlocks is removed. Typically, these padlocks take different keys and are owned or used by different persons or entities. The hole 20 in the housing may be used to temporarily hold the removed lock member and padlocks 44, as shown in FIG. 9.

Figures 9, 10, 11, 12, 13:
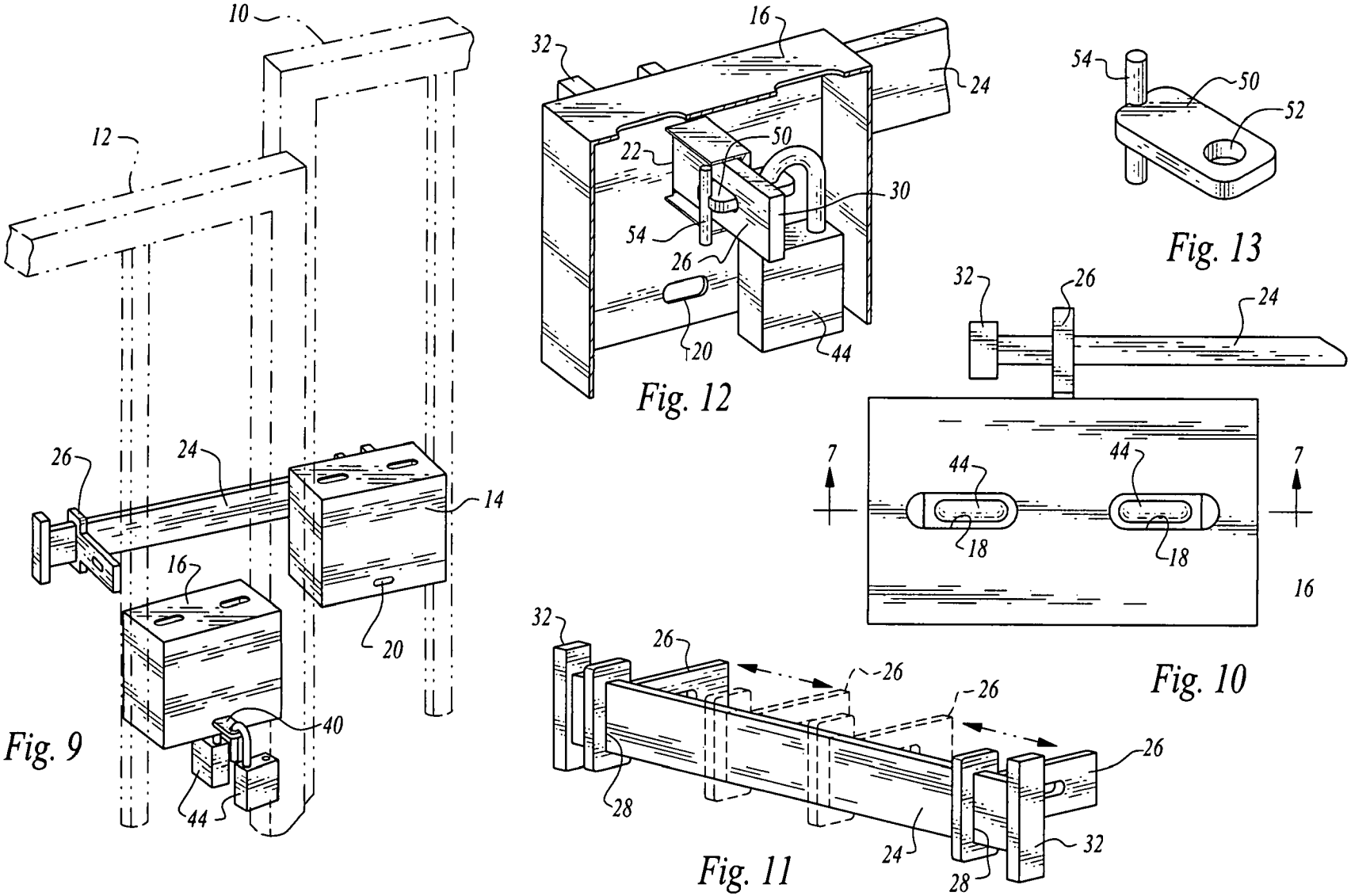
FIG. 9 is a perspective view showing in phantom line portions of the gate members being opened and in solid line the backs of the housings, one housing being separated from the latch bar and showing the removed padlock hanging from an end of a lock member projecting from the housing.
FIG. 10 is a top view of a portion of the apparatus, including a housing and a segment of the latch bar, the shackles of the two padlocks in place within the housing being observed through openings in the top of the housing.
FIG. 11 is a perspective view of the latch bar and the two latch bar supports, double-headed arrows illustrating alternative positioning of the latch bar supports along the length of the latch bar.
FIG. 12 is a view similar to FIG. 4, but illustrating an alternative form of lock member having a single padlock attached thereto.
FIG. 13 is an enlarged, perspective view of the alternative form of lock member.

FIGS. 12 and 13 illustrate a different embodiment of lock member 50 which incorporates only one lock member opening 52. A projection in the form of a pin or rod 54 is attached to the end of the lock member 50 remote from lock member opening 52. FIG. 12 shows lock member 50 in place in a latch bar support 26. In this configuration, only one padlock is accommodated and used to positively lock the latch bar support 26 in position.

The projection 54 is of a size and configuration preventing passage thereof through a latch bar support opening 36.

The invention claimed is:

1. Gate multi-locking apparatus comprising, in combination:

a gate having a gate end and movable between an open position and a closed position;

a first housing attached to said gate at or near said gate end and defining a first housing interior;

a structural member adjacent to said gate end;

a second housing attached to the structural member and defining a second housing interior;

a rigid double-ended latch bar positioned externally of said first and second housings and extending therebetween to prevent movement of said gate from said closed position to said open position;

a first latch bar support slidably supporting said latch bar externally of said first housing, extending into said first housing and having a distal end portion positioned within said first housing interior;

first stabilizer structure defining a stabilizer structure opening located within said first housing interior engaging and stabilizing the distal end portion of said first latch bar support;

a second latch bar support spaced from said first latch bar support slidably supporting said latch bar externally of said second housing, extending into said second housing and having a distal end portion positioned within said second housing interior, the distal end portions of said first and second latch bar supports defining latch bar support openings;

second stabilizer structure defining a stabilizer structure opening located within said second housing interior engaging and stabilizing the distal end portion of said second latch bar support;

a first lock member extending through the latch bar support opening of said first latch bar support and through the stabilizer structure opening of said first stabilizer structure locking said first latch bar support to said first housing to prevent said first latch bar support and said latch bar from being separated from said first housing;

a second lock member extending through the latch bar support opening of said second latch bar support and through the stabilizer structure opening of said second stabilizer structure locking said second latch bar support to said second housing to prevent said second latch bar support and said latch bar from being separated from said second housing; and at least one padlock in the first housing interior releasably connected to said first lock member to selectively retain said first lock member in the latch bar support opening defined by said first latch bar support and in the stabilizer structure opening of said first stabilizer structure, and at least one padlock in the second housing interior releasably connected to said second lock member to selectively retain said second lock member in the latch bar support opening defined by said second latch bar support and in the stabilizer structure opening of said second stabilizer structure, removal of a padlock from either of said first and second lock members enabling complete removal of a lock member from a latch bar support opening and a stabilizer structure opening and separation of a latch bar support and latch bar from a housing whereby the latch bar will not prevent movement of said gate to said open position.

2. The gate multi-locking apparatus according to claim 1 wherein said first and second lock members define lock member openings receiving said padlocks.

3. The gate multi-locking apparatus according to claim 2 wherein at least one of said first and second lock members defines two lock member openings spaced from one another and positioned on opposite sides of a latch bar support and a stabilizer structure when extending through the latch bar support opening and stabilizer structure opening thereof for receiving two padlocks, removal of either one of said two padlocks enabling removal of the lock member.

4. The gate multi-locking apparatus according to claim 3 wherein each of said first and second lock members defines two lock member openings spaced from one another and positioned on opposite sides of a latch bar support and a stabilizer structure when extending through the latch bar support opening and stabilizer structure opening thereof for receiving separate padlocks, removal of any of the padlocks enabling removal of a lock member.

5. The gate multi-locking apparatus according to claim 2 wherein at least one of said first and second lock members defines a single opening and includes a projection spaced from said single opening, said projection being of a size and configuration preventing passage thereof through a latch bar support opening.

6. The gate multi-locking apparatus according to claim 1 wherein said structural member comprises a second gate movable between an open position and a closed position.

7. The gate multi-locking apparatus according to claim 1 wherein said latch bar includes stops at the ends thereof for maintaining said latch bar supports and said latch bar interconnected.

8. The gate multi-locking apparatus according to claim 1 wherein said padlocks are located within the first and second housing interiors.

9. The gate multi-locking apparatus according to claim 8 wherein said first and second housings have open bottoms allowing manual access to said padlocks, said padlocks being completely disposed within said first and second housing interiors.

10. The gate multi-locking apparatus according to claim 9 wherein said first and second housings define view holes for viewing the first and second housing interiors.

* * * * *